US008307576B1

(12) United States Patent
Bogart et al.

(10) Patent No.: US 8,307,576 B1
(45) Date of Patent: Nov. 13, 2012

(54) FIREARM SUPPORT APPARATUS

(76) Inventors: Mark Bogart, Joshua, TX (US); Daniel Bogart, Jr., Joshua, TX (US)

( * ) Notice: Subject to any disclaimer, the term of this patent is extended or adjusted under 35 U.S.C. 154(b) by 305 days.

(21) Appl. No.: 12/702,679

(22) Filed: Feb. 9, 2010

(51) Int. Cl.
*F41C 27/00* (2006.01)

(52) U.S. Cl. ..... 42/94; 89/37.04; 248/176.1

(58) Field of Classification Search ..... 42/94; 89/37.04; 73/167; 248/124.1, 176.1
See application file for complete search history.

(56) References Cited

U.S. PATENT DOCUMENTS

| | | | | |
|---|---|---|---|---|
| 4,026,057 | A | 5/1977 | Cady | |
| 6,526,687 | B1 * | 3/2003 | Looney | 42/94 |
| 6,546,662 | B1 | 4/2003 | Chong | |
| 6,877,266 | B1 * | 4/2005 | Brownlee | 42/94 |
| D521,100 | S | 5/2006 | Morrow | |
| D553,219 | S | 10/2007 | Potterfield et al. | |
| D576,245 | S | 9/2008 | Potterfield et al. | |
| 7,584,690 | B2 | 9/2009 | Cauley | |
| 8,052,104 | B2 * | 11/2011 | Clampitt | 248/178.1 |

* cited by examiner

*Primary Examiner* — Daniel Troy
(74) *Attorney, Agent, or Firm* — Eric Karich

(57) ABSTRACT

A firearm support apparatus has a table element having legs for supporting the table element in a generally horizontal configuration, a forward cradle assembly mounted on a forward portion of the table element, and a rearward cradle assembly mounted on a rearward portion of the table element. The forward cradle assembly may comprise a mounting post, an adjustment plate mounted on the mounting collar and extending laterally therefrom, and a pair of adjustment collars mounted on the adjustment plate laterally spaced from one another. A lateral adjustment rod has ends engaged with the adjustment collars, and an externally threaded median portion threadedly engaged with an adjustment slide. A forward cradle is mounted on an adjustment slide for adjustable mounting a forward part of the rifle.

4 Claims, 5 Drawing Sheets

FIREARM SUPPORT APPARATUS

BACKGROUND OF THE INVENTION

1. Field of the Invention

This invention relates generally to firearm supports, and more particularly to a forearm support apparatus for supporting a rifle and for adjusting the aim of the rifle while the rifle is mounted on the apparatus.

2. Description of Related Art

Gun rests are useful tools for accurately sighting rifles and similar firearms. It is important that the shooter, such as a hunter, be able to maintain a shooting position with the gun properly aimed, for periods of time (e.g., while waiting for a target such as a deer to arrive).

Accurate sighting and adjustment of the gun sights is especially critical for shooting at long ranges, where small changed is relative position of the gun can result in significant shooting errors.

Various prior art references teach gun rests of various construction and design. For example, Brownlee, U.S. Pat. No. 6,877,266, teaches a forearm support that includes a front support assembly and a rail assembly operatively coupled to the front support assembly. The support includes a horizontal adjustment mechanism for adjusting the position of the firearm.

Looney, U.S. Pat. No. 6,526,687, teaches a gun rest that includes a table having a forward fore stock support, and a rearward butt stock support. The fore stock support is mounted on a front of the table, and includes a screw that pushes against the bias of an internal spring for horizontal adjustment of the support. Both the forward and rearward supports include screws for the vertical adjustment of the gun. Another example of a similar construction is shown in Cady, U.S. Pat. No. 4,026,057. The above-described references are hereby incorporated by reference in full.

The prior art teaches firearm supports that are horizontally and vertically adjustable. However, the prior art does not teach a horizontal adjustment mechanism that includes the benefits of construction and ease of use as taught in the present invention. The present invention fulfills these needs and provides further related advantages as described in the following summary.

SUMMARY OF THE INVENTION

The present invention teaches certain benefits in construction and use which give rise to the objectives described below.

The present invention provides a firearm support apparatus for supporting a rifle. The firearm support apparatus comprises a table element having legs for supporting the table element in a generally horizontal configuration, the table element having a forward portion and a rearward portion; a forward cradle assembly mounted on the forward portion of the table element; and a rearward cradle assembly mounted on the rearward portion of the table element for supporting a rearward part of the rifle.

In one embodiment of the invention, the forward cradle assembly comprises a mounting post extending upwardly from the front portion the table element; a mounting collar adapted to be removably mounted on the mounting post; an adjustment plate mounted on the mounting collar and extending laterally therefrom; a pair of adjustment collars mounted on the adjustment plate laterally spaced from one another, each of the adjustment collars having a conduit; a lateral adjustment rod having ends and an externally threaded median portion, the ends being engaged through the conduits of the pair of adjustment collars; an adjustment knob attached to one of the ends of the lateral adjustment rod for rotating the screw within the pair of adjustment collars; an adjustment slide threadedly engaged with the externally threaded median portion of the lateral adjustment rod, between the pair of adjustment collars, such that rotation of the adjustment knob turns the lateral adjustment rod, thereby moving the adjustment slide laterally with respect to the adjustment plate; and a forward cradle mounted on the adjustment slide, the cradle arms fitting around and supporting the forward part of the rifle.

In another embodiment of the invention, the table element includes leg receivers on the table element for receiving legs, positioned such that when the legs are installed in the leg receivers, the legs function to support the table element in a generally horizontal configuration; a storage rack mounted adjacent the bottom surface of the table element for receiving and storing the legs between the storage rack and the table element; and a locking arm extending from each of the legs, the locking arm being shaped to interlock with the storage rack for locking the leg between the storage rack and the table element.

In another embodiment of the invention, the table element includes a slot adjacent an edge of the table element, forming a handle element between the slot and the edge for carrying the table element.

A primary objective of the present invention is to provide a firearm support apparatus having advantages not taught by the prior art.

Another objective is to provide a firearm support apparatus that includes a horizontal adjustment mechanism that includes the benefits of construction and ease of use as taught in the present invention.

Another objective is to provide a firearm support apparatus that includes a table element that includes a simple and inexpensive storage system for legs of the table element.

A further objective is to provide a firearm support apparatus that includes a handle in the table element for easy portability of the apparatus.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a firearm support apparatus for supporting a rifle.

Figure 1:
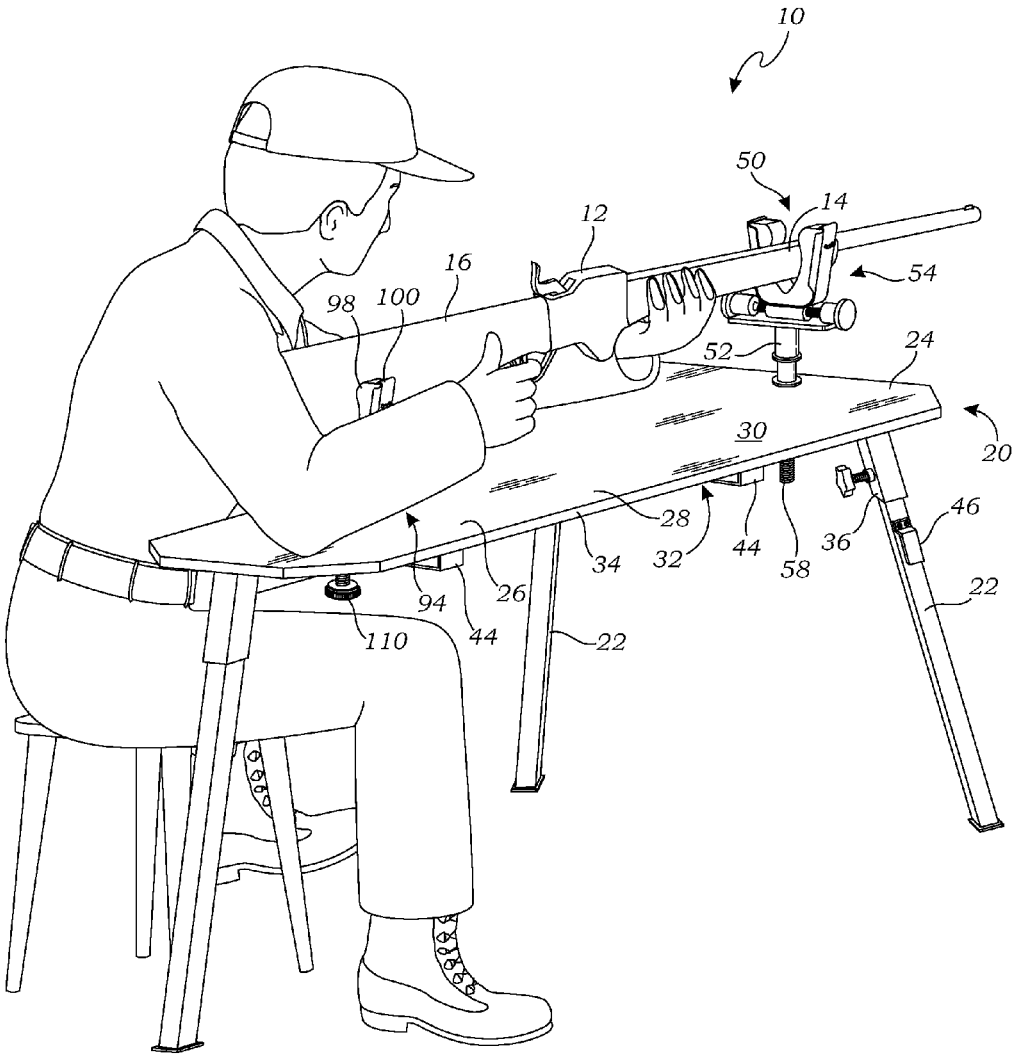
FIG. 1 is a perspective view of a firearm support apparatus according to one embodiment of the present invention, illustrating a hunter using a rifle operably mounted on the firearm support apparatus.
Figure 2:
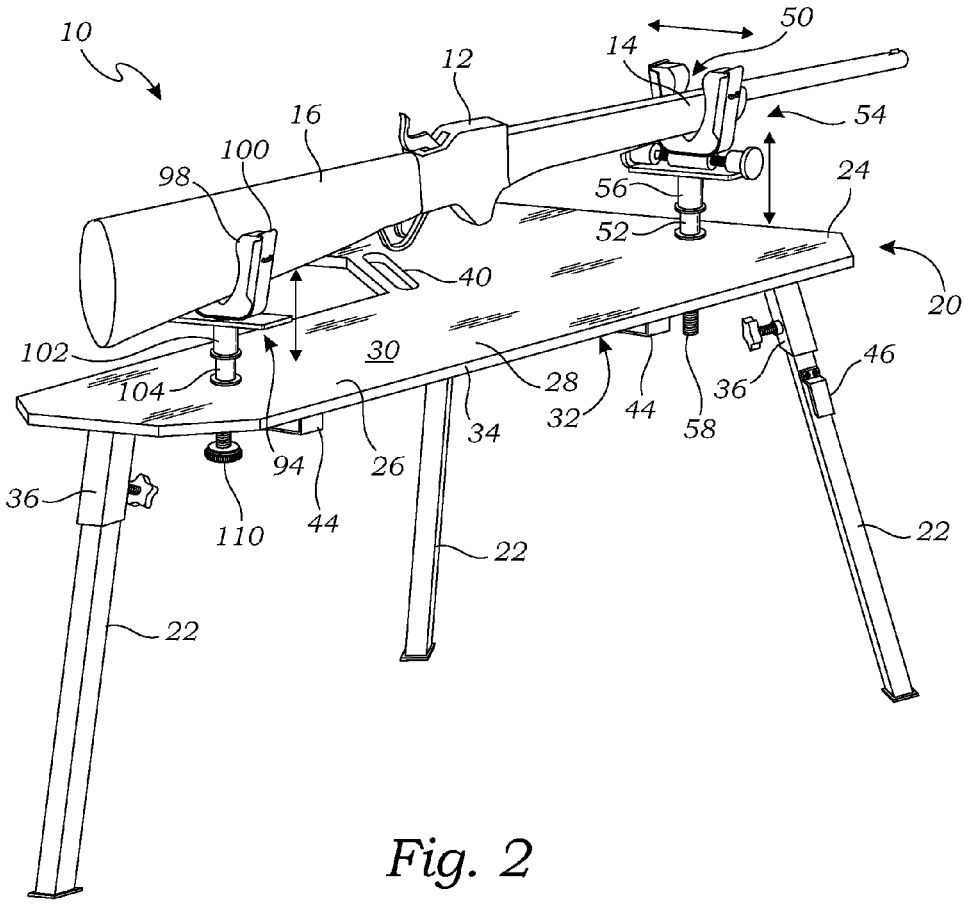
FIG. 2 is a perspective the firearm support apparatus, illustrating a table element having a forward cradle assembly and a rearward cradle assembly, the table element being supported in a horizontal configuration on legs.
Figure 3:
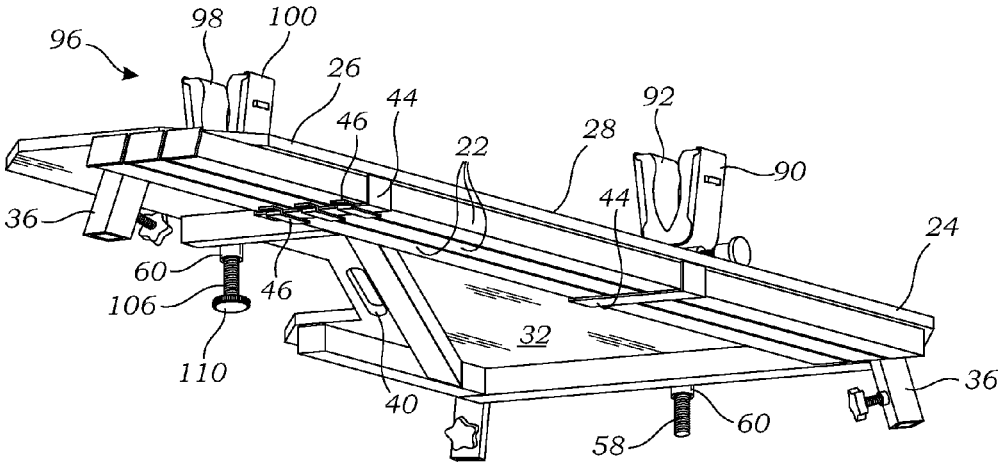
FIG. 3 a bottom perspective view of the firearm support apparatus, illustrating the legs in a stored configuration.
Figure 4:
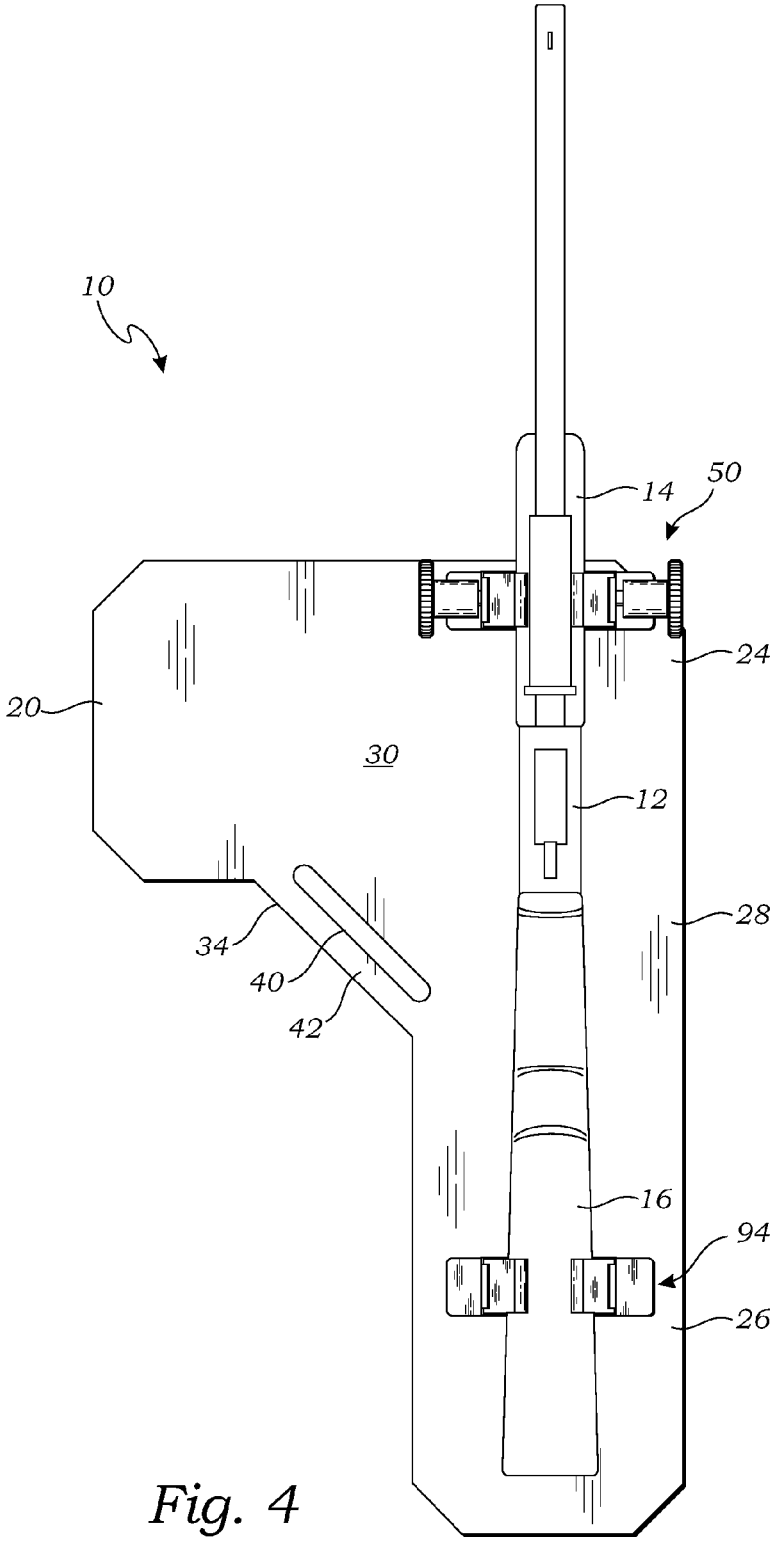
FIG. 4 is a top plan view of the firearm support apparatus of FIG. 2.

FIG. 1 is a perspective view of a firearm support apparatus 10 according to one embodiment of the present invention, illustrating a hunter using a rifle 12 operably mounted on the firearm support apparatus 10. FIG. 2 is a perspective the firearm support apparatus 10, illustrating a table element 20 supported in a horizontal configuration on legs 22. FIG. 3 a bottom perspective view of the firearm support apparatus 10, illustrating the legs 22 once they have been removed and placed in a stored configuration, described below. FIG. 4 is a top plan view of the firearm support apparatus 10 of FIG. 2.

As illustrated in FIGS. 1-4, the table element 20 operably supports a forward cradle assembly 50 and a rearward cradle assembly 94. The table element 20 has legs 22 for supporting the table element 20 in a generally horizontal configuration. The table element 20 has a forward portion 24 and a rearward portion 26. The table element 20 is generally shaped and configured for use by a hunter (e.g., hunting from a blind, or otherwise), so that the hunter may sit at or adjacent the table element 20, such that the hunter is comfortably able to aim the rifle 12.

In one embodiment, the forward portion 24 and the rearward portion 26 are connected by a center body 28. The center body 28 may be a planar structure, similar to a standard table. The table element 20 may include a top surface 30 and an opposed bottom surface 32 connected by an edge 34. In one embodiment, the table element 20 includes leg receivers 36 for receiving the legs 22, which may be separable from the table element 20. The leg receivers 36 are positioned such that when the legs 22 are installed in the leg receivers 36, the legs 22 function to support the table element 20 in a generally horizontal configuration, as described above.

A slot 40 may be formed through the table element 20 adjacent the edge 34 forming a handle element 42, between the slot 40 and the edge 34, for carrying the table element 20. The slot 40 is preferably the size of a human hand to facilitate carrying the table element 20.

In one embodiment, the table element 20 includes a storage rack 44 (in this embodiment, a pair of storage rack 44s) mounted adjacent the bottom surface 32 of the table element 20 for receiving and storing the legs 22 between the storage rack 44 and the table element 20. In one embodiment, a locking arm 46 extends from each of the legs 22. The locking arm 46 is shaped to interlock with one of the storage racks 44 for locking the leg between the storage racks 44 and the table element 20. In one embodiment, the locking arm 46 is generally L-shaped, but alternative shapes and structures may be utilized to store the legs 22 beneath the table element 20, and such alternatives should be considered within the scope of the present invention.

Figure 5:
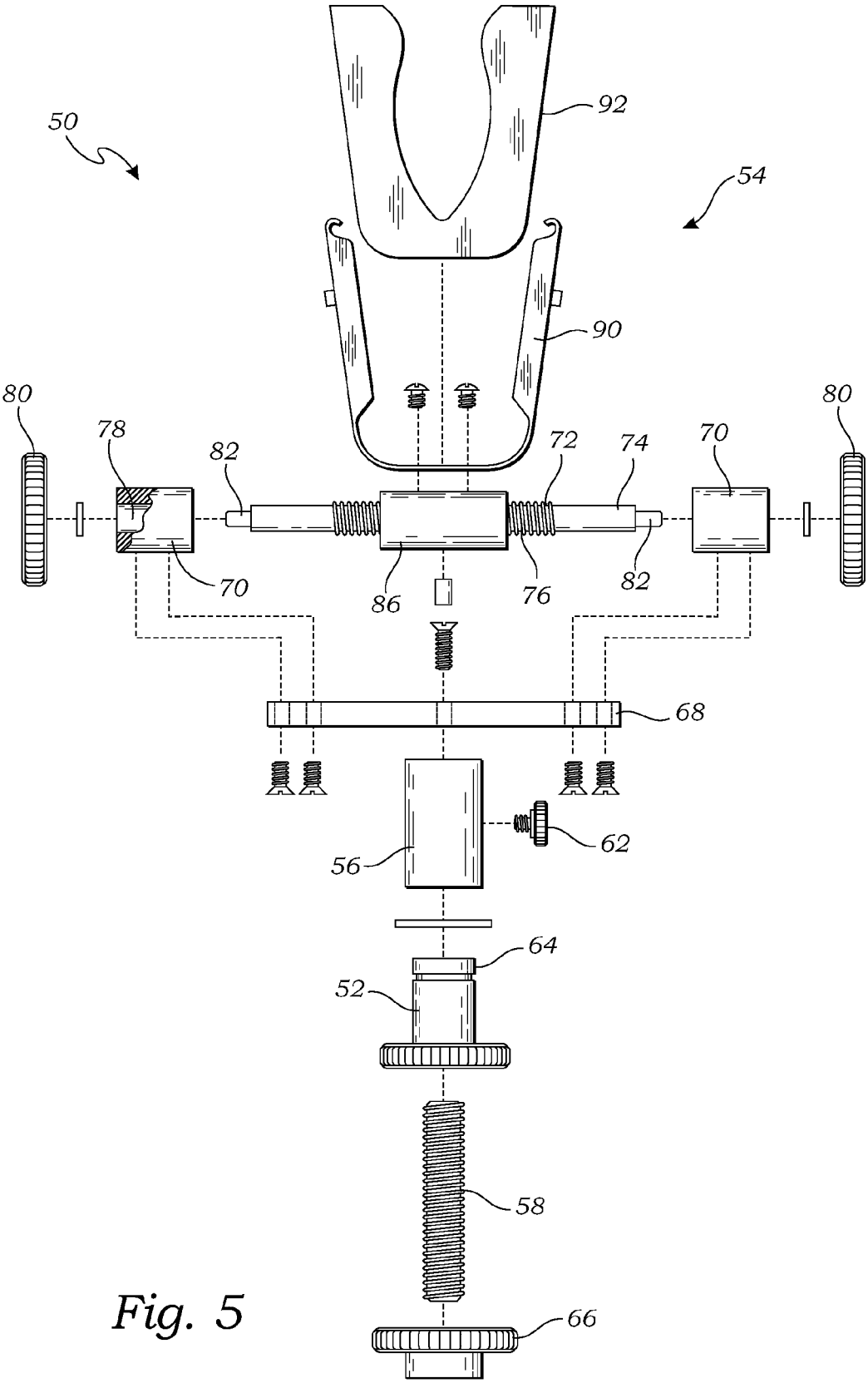
FIG. 5 is an exploded front elevational view of the forward cradle assembly.

FIG. 5 is an exploded front elevational view of the forward cradle assembly 50. As illustrated in FIG. 5, the forward cradle assembly 50 is mounted on the forward portion 24 of the table element 20, and comprises a mounting post 52 extending upwardly from the front portion the table element 20. The mounting post 52 may be mounted on the table element 20 using any constructions known in the art. The mounting post 52 supports a forward cradle 54 for supporting a forward part 14 (e.g., forestock) of the rifle 12.

In one embodiment, a mounting collar 56 is adapted to be removably mounted on the mounting post 52. In this embodiment, a mounting screw 58 is positioned through and threadedly engaged with the table element 20 (e.g., through an internally threaded bracket 60) to extend upwardly from the table element 20, and the mounting post 52 is mounted on the mounting screw 58. In this manner, rotation of the mounting screw 58 functions to vertically adjust the position of the mounting post 52, and thus the vertical position of the forward cradle 54. The mounting collar 56 may further comprise a locking screw 62 through the mounting collar 56 for engaging an annular groove 64 in the mounting post 52 for locking the mounting collar 56 on the mounting post 52. While the present embodiment illustrates a certain male/female relationship between the mounting post 52 and mounting collar 56, this relationship may be reversed, and the terms used herein are expressly defined to include the inverse interlocking relationship.

The mounting screw 58 may be used in conjunction with a front adjuster nut 66 that is threadedly mounted on the mounting screw 58 for locking the mounting screw 58 in a given position. The front adjuster nut 66 allows a user to lock the forward cradle 54 in a selected vertical position. While the mounting screw 58 and associated elements are utilized in the present embodiment for engaging the forward cradle 54 with the table element 20, alternative constructions (e.g., non-threaded post, or similar structure) may also be used, as can alternative locking elements.

An adjustment plate 68 is mounted on the mounting collar 56 and extends 74 laterally therefrom. A pair of adjustment collars 70 are mounted on the adjustment plate 68 laterally spaced from one another. A lateral adjustment rod 72 has ends 74 and an externally threaded median portion 76. The ends 74 of the lateral adjustment rod 72 are engaged through a conduit 78 of the adjustment collar. The term "conduit 78" is hereby defined to include any form of passage, slot 40, or similar construction that may rotatably receive the adjustment post, as described herein. In the preferred embodiment, the adjustment collars 70 are generally cylindrical constructions that are attached to the adjustment plate 68 with screws, although welding and other methods are also possible.

An adjustment knob 80 is attached to one of the ends 74 of the lateral adjustment rod 72 for rotating the lateral adjustment rod 72 within the pair of adjustment collars 70. In one embodiment, a second adjustment knob 80 is also provided at the other end of the lateral adjustment rod 72, so that the horizontal position of the forward cradle assembly 50 may be adjusted from either side. In the embodiment of FIG. 5, adjustment knobs 80 are forcibly pressed onto studs 82 on each of the ends 74 so that the adjustment knobs 80 are fixedly engaged with the lateral adjustment rod 72. In alternative embodiments, they may be attached threadedly, with pins, or other methods of attachment.

An adjustment slide 86 is threadedly engaged with and supported by the externally threaded median portion 76 of the lateral adjustment rod 72, between the pair of adjustment collars 70, such that rotation of the adjustment knob 80 turns the lateral adjustment rod 72, thereby moving the adjustment slide 86 laterally with respect to the adjustment plate 68. In this embodiment, the forward cradle 54 is mounted on the adjustment slide 86 for supporting the rifle 12.

In one embodiment, the forward cradle 54 includes a pair of rigid, upwardly extending cradle arms 90, and a U-shaped foam component 92 positioned between the upwardly extending cradle arms 90. The U-shaped foam component 92 functioning to clamp the rifle 12 securely and yet without damaging the rifle 12.

Figure 6:
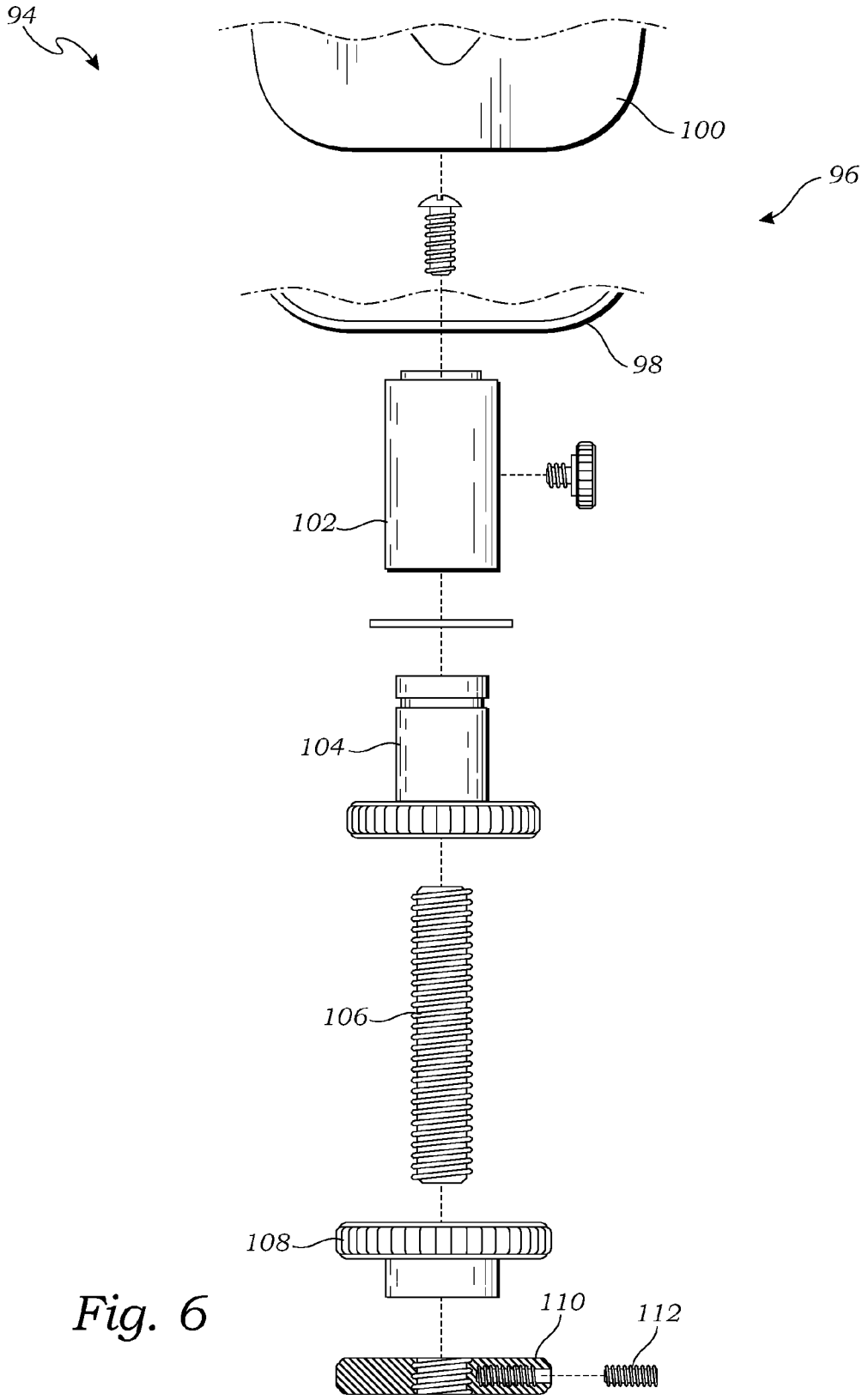
FIG. 6 is an exploded front elevational view of the rearward cradle assembly.

FIG. 6 is an exploded front elevational view of the rearward cradle assembly 94. The rearward cradle assembly 94 may be mounted on the rearward portion 26 of the table element 20 for supporting a rearward part 16 (e.g., butt stock) of the rifle 12. As illustrated in FIG. 6, the rearward cradle assembly 94 may include a construction similar to the forward cradle assembly 50, comprising a rearward cradle 96 supported by a rear mounting post 104.

The rearward cradle may include a rear mounting collar 102 attached to rear cradle arms 98 and a rear U-shaped foam component 100. The rear mounting collar 102 may be adapted to be removably mounted on the rear mounting post 104. In the present embodiment, a rear mounting screw 106 may be positioned through and threadedly engaged with the table element 20 (e.g., through an internally threaded bracket 60) to extend upwardly from the table element 20, and the rear mounting post 104 may mounted on the rear mounting screw 106. In this manner, rotation of the rear mounting screw 106 functions to vertically adjust the position of the rear mounting post 104, and thus the vertical position of the rearward cradle 96.

As with the forward cradle assembly 50, the rear mounting screw 106 may be used in conjunction with a rear adjuster nut 108 that is threadedly mounted on the rear mounting screw 106 for locking the rear mounting screw 106 in a given position. The rear adjuster nut 108 allows a user to lock the rearward cradle 96 in a selected vertical position.

In the present embodiment, the rearward cradle assembly 94 further includes a bottom adjustment knob 110 that is threadedly engaged with the rear mounting screw 106 and locked in place with a set screw 112. The bottom adjustment knob 110 enables the user to easily reach under the table element 20 and rotate the rear mounting screw 106 for fine adjustment of the vertical position of the rearward part 16 of the rifle 12.

While the rear mounting screw and associated elements are utilized in the present embodiment for engaging the rearward cradle with the table element 20, alternative constructions (e.g., non-threaded post, or similar structure) may also be used, as can alternative locking elements.

The terminology used in the specification provided above is hereby defined to include similar and/or equivalent terms, and/or alternative embodiments that would be considered obvious to one skilled in the art given the teachings of the present patent application. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A firearm support apparatus for supporting a rifle, the rifle having a forward part and a rearward part, the firearm support apparatus comprising:

a table element having legs for supporting the table element in a generally horizontal configuration, the table element having a forward portion and a rearward portion;

a forward cradle assembly mounted on the forward portion of the table element, the forward cradle assembly comprising:

a mounting post extending upwardly from the front portion the table element;

a mounting collar adapted to be removably mounted on the mounting post;

an adjustment plate mounted on the mounting collar and extending laterally therefrom;

a pair of adjustment collars mounted on the adjustment plate laterally spaced from one another, each of the adjustment collars having a conduit;

a lateral adjustment rod having ends and an externally threaded median portion, the ends being engaged through the conduits of the pair of adjustment collars;

an adjustment knob fixedly attached to a stud in one of the ends of the lateral adjustment rod for rotating the lateral adjustment rod within the pair of adjustment collars;

an adjustment slide threadedly engaged with the externally threaded median portion of the lateral adjustment rod, between the pair of adjustment collars, such that rotation of the adjustment knob turns the lateral adjustment rod, thereby moving the adjustment slide laterally with respect to the adjustment plate; and a forward cradle mounted on the adjustment slide, the forward cradle includes a pair of rigid, upwardly extending cradle arms to fit around and support the forward part of the rifle; and a rearward cradle assembly mounted on the rearward portion of the table element for supporting the rearward part of the rifle, the rearward cradle assembly comprising:

rear cradle arms shaped to fit around and receive the rearward part of the rifle;

a rear mounting collar extending downwardly from the rear cradle arms;

a rear mounting post that extends into and pivotally engages the rear mounting collar;

a locking screw through the rear mounting collar for engaging an annular groove in the rear mounting post for locking the mounting collar on the mounting post, while allowing the rear mounting post to pivot;

a rear mounting screw engaged with the rear mounting post opposite the rear mounting collar, the rear mounting screw being positioned through the table element and threadedly engaged with an internally threaded bracket of the table element; and a bottom adjustment knob attached to the rear mounting screw, whereby rotation of the rear mounting screw via the bottom adjustment knob functions to vertically adjust the position of the rear mounting post, and thus the vertical position of the rearward cradle.

2. The firearm support apparatus of claim 1, wherein the forward cradle further includes a U-shaped foam component positioned between the upwardly extending cradle arms, the U-shaped foam component functioning to clamp the rifle securely and yet without damaging the rifle.

3. The firearm support apparatus of claim 1, further comprising a locking screw through the mounting collar for engaging an annular groove in the mounting post for locking the mounting collar on the mounting post.

4. The firearm support apparatus of claim 3, further comprising a mounting screw threadedly engaged with the table element and the mounting post for vertically adjusting the location of the mounting post.

* * * * *